US005464026A

United States Patent [19]

Gardner et al.

[11] Patent Number: 5,464,026

[45] Date of Patent: Nov. 7, 1995

[54] DEVICE FOR SMOKING TOBACCO AND THE LIKE

[76] Inventors: James H. Gardner, 11F, Hyde Park Mansions, London NW1 5BA; Nicholas M. Crayson, 16, Palliser Road, Barons Court, London W14 9EE, both of England

[21] Appl. No.: 179,630

[22] Filed: Jan. 11, 1994

[51] Int. Cl.[6] ..... A24F 1/16

[52] U.S. Cl. ..... 131/216; 131/195

[58] Field of Search ..... 131/216, 224, 131/195, 330; 446/24; D27/100, 163–165

[56] References Cited

U.S. PATENT DOCUMENTS

| | | | |
|---|---|---|---|
| 2,330,389 | 9/1943 | Smith | 131/195 X |
| 3,631,864 | 1/1972 | Beard | 131/216 X |
| 3,834,402 | 9/1974 | Paul | 131/225 X |
| 3,902,505 | 9/1975 | Carleton | D27/163 X |
| 4,398,547 | 8/1983 | Gillis | 131/216 |

FOREIGN PATENT DOCUMENTS

| | | | |
|---|---|---|---|
| 499154 | 1/1939 | United Kingdom | 131/195 |

*Primary Examiner*—Jennifer Bahr
*Attorney, Agent, or Firm*—Foley & Lardner

[57] ABSTRACT

A device for smoking tobacco and the like has a housing having an upper wall and a lower wall, the upper wall mounting an air-permeable membrane communicating with a channel formed between the walls, and the channel being open at an end to the atmosphere. The upper and lower walls are preferably substantially planar and releasably attached together, for example by magnetic means. The air-permeable membrane suitably has a metal gauze mounted in an aperture formed in the upper wall, and the channel is preferably labyrinthine in form.

8 Claims, 2 Drawing Sheets

DEVICE FOR SMOKING TOBACCO AND THE LIKE

The present invention relates to devices for smoking tobacco and the like.

The conventional tobacco pipe comprises a hollow stem having a mouthpiece at one end and a tobacco-receiving bowl at the other. Pipes having this general configuration have been in use for hundreds of years. A disadvantage of them is that they tend to be bulky, and can thereby disturb the shape of a pocket when not in use and being carried in, for example, a jacket. It is an object of the present invention to provide an alternative device to the conventional pipe, for smoking tobacco and the like, which may for example be stowed in a pocket without disturbing the lines thereof.

According to the invention there is provided a device for smoking tobacco and the like comprising a housing having an upper wall and a lower wall, the upper wall mounting an air-permeable membrane communicating with a channel formed between the walls, the channel being open at an end to the atmosphere.

In a preferred embodiment the housing has the general overall shape of a credit card, the upper and lower walls being substantially flat pressings or castings, attached, suitably releasably attached, together. Such releasable attachment may be by magnetic means attached to one or other of the upper and lower walls.

The air-permeable membrane suitably comprises a metal gauze, e.g. a stainless steel gauze. Indeed, both the upper and lower walls are preferably made from stainless steel by casting or pressing.

The air-permeable membrane is preferably mounted in an aperture formed in the upper wall, the aperture suitably being bounded by a raised lip so as to surround and contain the charge of tobacco seated on the membrane.

The channel, which connects the air-permeable membrane with the open end of the device, is suitably formed by a groove which is formed or cast in the inner surface of the lower wall. Such groove faces the lower wall, and forms a channel through which a mixture of air and smoke may pass from the membrane to the open end of the channel. The channel may be labyrinthine in form, to enable the air-smoke mixture to cool before it reaches the open end, and suitably the channel comprises a plurality of interconnected depressions formed on the inside surface of the upper wall, each depression containing a lateral baffle formed therein.

An embodiment of the invention will now be described with reference to the accompanying drawings.

THE DRAWINGS

Figure 1:
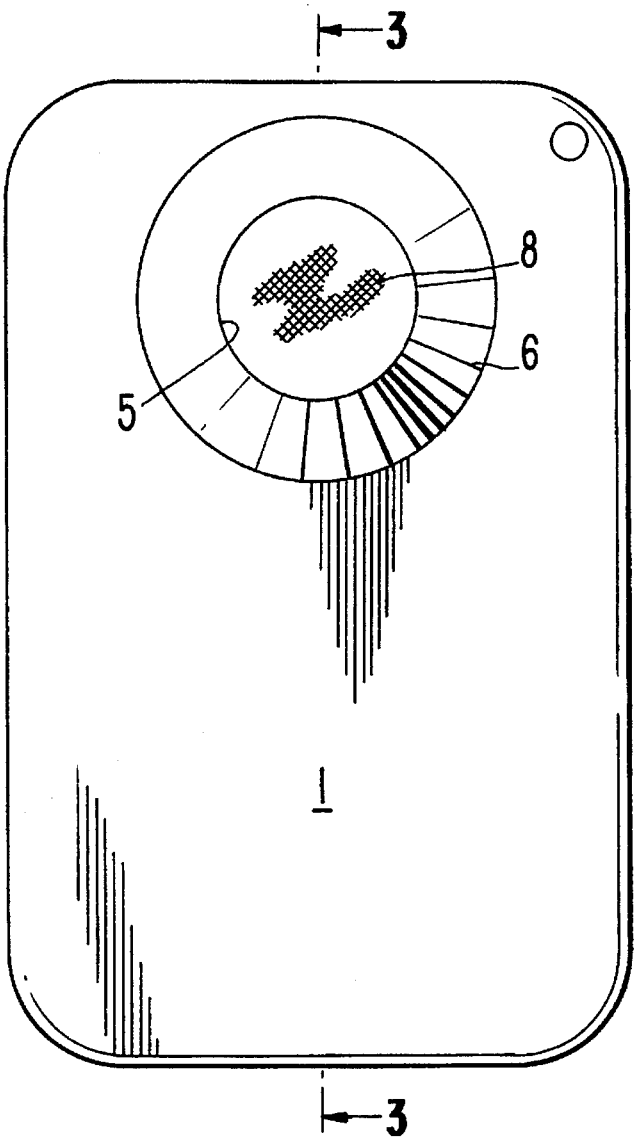
FIG. 1 is a plan view of a smoking device according to the invention.
Figure 3:
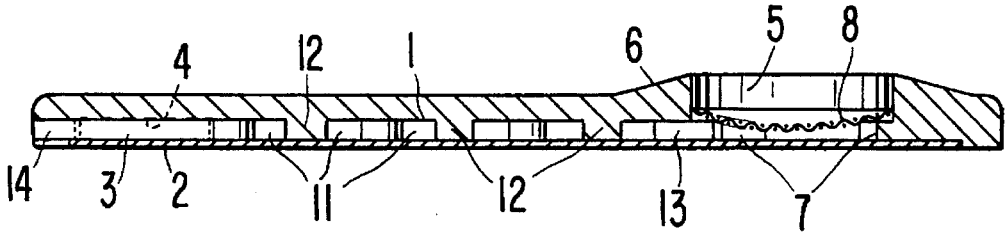
FIG. 3 is a longitudinal section on the line 3—3 of FIG. 1.
Figure 2:
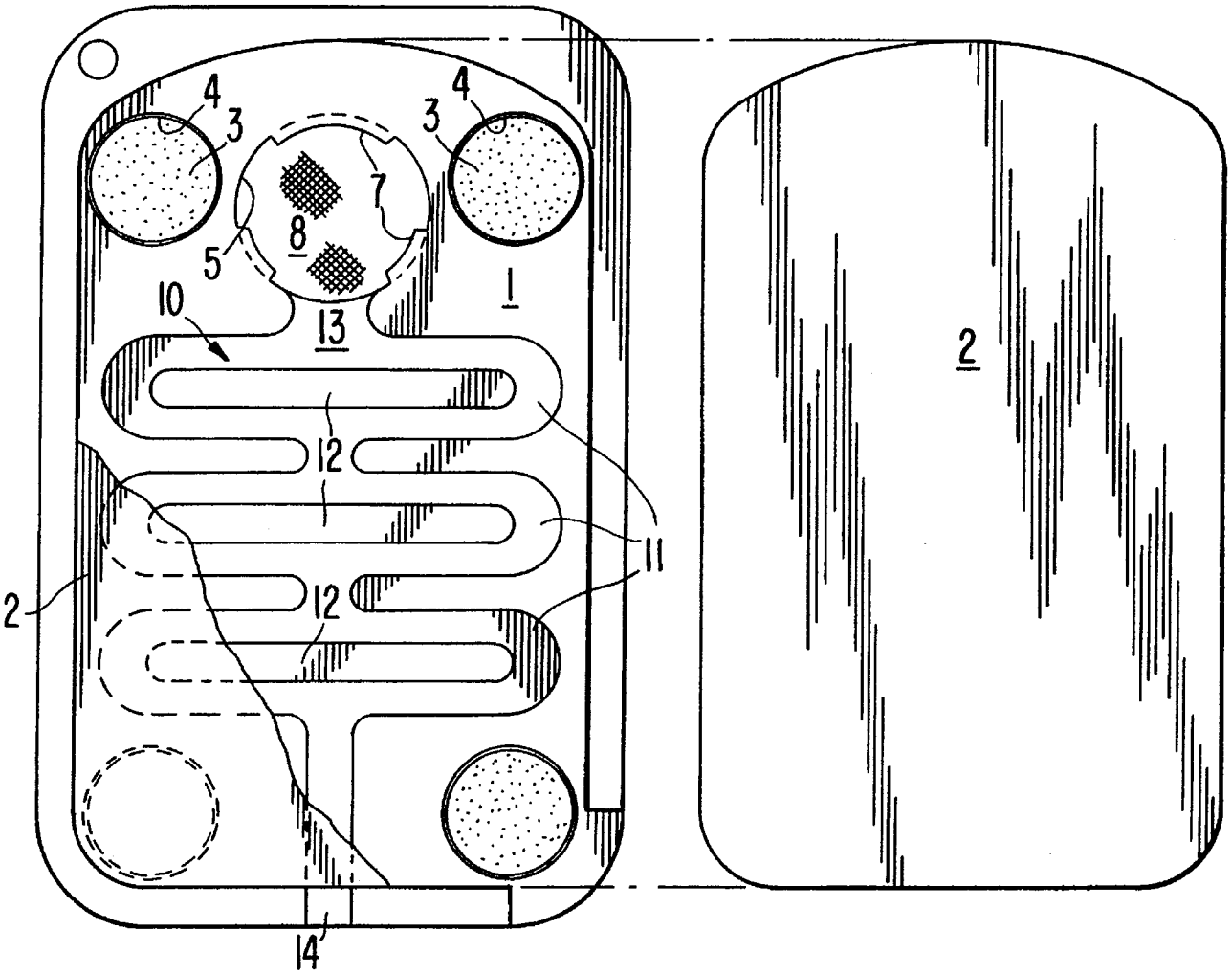
FIG. 2 is an internal view of the device with the base plate shown separated.

The smoking device comprises an upper wall 1, suitably cast from stainless steel, and a lower wall 2 releasably attached to the upper wall 1. Such releasable attachment is by means of magnets 3 mounted in seats 4 formed on the inner surface of the upper wall 1. A circular aperture 5 is formed in the upper wall 1, and is surrounded by a raised circular lip 6. Mounted on seats 7 formed in the aperture 5 is a circular stainless steel gauze 8 on which, in use, is charged a small quantity of tobacco or the like.

The inner surface of the upper wall 1 is formed with a groove 10 comprising a series of interconnected depressions 11 having lateral baffles 12 formed therein. At one end, 13, the groove 10 communicates with the aperture 5, and at the other end, 14, it is open to the atmosphere. In use, a mixture of smoke and air is drawn through the membrane 8, along the channel 10, and is discharged into the mouth of the smoker through the outlet at the open end 14. By forming the groove 11 in labyrinthine form, with intermediate baffles 12, the length of the air passage between the membrane 8 and the outlet 14 is sufficiently long that the smoke drawn through the membrane 8 will have cooled by the time it reaches the outlet 14.

The bottom wall 2 of the device is shown in the drawings as releasably attached, by magnets, to the upper wall. This is not of course essential, and the two walls may be permanently attached to each other. Releasably attaching them as shown in the drawings, however, has the advantage that the smoking device may be readily cleaned. Thus, it is envisaged that, after a certain time of use, the membrane 8 will be removed and discarded, the lower wall 2 removed in order to clean the channel 10, and then the lower wall 2 replaced and a new membrane 8 placed within the aperture 5.

The device of the invention is suitably of a compact form, the upper and lower walls suitably having the length and width of a credit card. Although the thickness of the device will be greater than that of a credit card, nevertheless the device is of compact appearance and, when not in use, can be stored in a pocket in an unobtrusive way.

What is claimed is:

1. A device for smoking tobacco, comprising:

a housing having an upper wall and a lower wall, the upper wall mounting an air-permeable membrane communicating with a channel formed between the walls, said channel being open at an end to the atmosphere;

wherein said upper and lower walls are substantially planar and said walls are releasably attached together; and wherein said releasable attachment is by magnetic means.

2. A device according to claim 1 wherein said air-permeable membrane comprises a metal gauze.

3. A device according to claim 1 wherein said air-permeable membrane is mounted in an aperture formed in the said upper wall.

4. A device according to claim 3 wherein said aperture is bounded by a raised lip.

5. A device according to claim 1 wherein said channel is labyrinthine in form.

6. A device according to claim 1, wherein said upper wall comprises a groove on its inner surface forming, with said lower wall, said channel.

7. A device as claimed in claim 1, wherein said channel comprises a plurality of interconnected depressions formed on the inside surface of the upper wall, each depression containing a lateral baffle formed therein.

8. A device for smoking tobacco, comprising:

a housing having an upper wall and a lower wall, the upper wall mounting an air-permeable membrane communicating with a channel formed between the walls, said channel being open at an end to the atmosphere;

wherein said channel comprises a plurality of interconnected depressions formed on the inside surface of the upper wall, each depression containing a lateral baffle formed therein.

* * * * *